US010969716B2

(12) United States Patent
Tamura et al.

(10) Patent No.: US 10,969,716 B2
(45) Date of Patent: Apr. 6, 2021

(54) NON-CONTACT IMAGE HEATING APPARATUS INCLUDING A SHIELDING MEMBER

(71) Applicant: CANON KABUSHIKI KAISHA, Tokyo (JP)

(72) Inventors: Shuichi Tamura, Moriya (JP); Shuhei Takahashi, Chiba (JP); Tomoharu Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/695,944

(22) Filed: Nov. 26, 2019

(65) Prior Publication Data

US 2020/0166877 A1 May 28, 2020

(30) Foreign Application Priority Data

Nov. 28, 2018 (JP) ..... JP2018-221778

(51) Int. Cl.
*G03G 15/20* (2006.01)
*G03G 15/00* (2006.01)

(52) U.S. Cl.
CPC ..... *G03G 15/2053* (2013.01); *G03G 15/2007* (2013.01); *G03G 15/70* (2013.01)

(58) Field of Classification Search
CPC ..... G03G 15/2007; G03G 15/2053; G03G 15/5012; G03G 15/70
See application file for complete search history.

(56) References Cited

U.S. PATENT DOCUMENTS 5,887,238 A * 3/1999 Matsuzoe ..... G03G 15/2007 219/216
2016/0070212 A1* 3/2016 Kamoda ..... G03G 15/2007 399/336
2016/0170339 A1* 6/2016 Takeda ..... G03G 15/2017 399/329
2017/0199489 A1* 7/2017 Shimomura ..... G03G 15/70

FOREIGN PATENT DOCUMENTS

JP 2010-122341 A 6/2010

* cited by examiner

*Primary Examiner* — Sophia S Chen
(74) *Attorney, Agent, or Firm* — Venable LLP

(57) ABSTRACT

An image heating apparatus includes a rotatable belt, a driving source, a heating portion, a heat shielding member, a shielding member moving mechanism, and a controller. The controller is configured to control the moving mechanism so that the shielding member is in a shielding position and rotation of the belt is at rest in a stand-by state in which the image heating apparatus waits for input of an image forming signal for forming the image.

10 Claims, 5 Drawing Sheets

NON-CONTACT IMAGE HEATING APPARATUS INCLUDING A SHIELDING MEMBER

CROSS-REFERENCE TO RELATED APPLICATIONS

This application claims the benefit of Japanese Patent Application No. 2018-221778 filed on Nov. 28, 2018, which is hereby incorporated by reference herein in its entirety.

FIELD OF THE INVENTION AND RELATED ART

The present invention relates to an image heating apparatus for heating a toner image in a non-contact manner in an electrophotographic image forming apparatus.

In general, fixing of an image in the electrophotographic image forming apparatus refers to that toner is melted by heat and is fixed on paper under application of pressure. Conventionally, in a fixing device in the electrophotographic image forming apparatus, a toner image formed on paper is generally fixed under application of heat and pressure by a heat roller or the like.

In Japanese Laid-Open Patent Application (JP-A) 2010-122341, a technique using ultraviolet radiation (energy) to cure a developer and, before ultraviolet irradiation, preheating the developer by irradiating the developer with infrared radiation has been proposed as a non-contact fixing device.

In the case when the developer is heated in the non-contact manner, as in JP-A 2010-122341, a non-contact heat source has heat even when electric power supply to the non-contact heat source is turned off, so that a heated state is continued. For that reason, a predetermined time from turning-off of the non-contact heat source after an end of a job or during detection of jam occurrence until the non-contact heat source is cooled to a predetermined temperature is needed. In that case, when rotation of a belt is stopped, a part of the belt is locally heated, so that there is a liability that a lifetime of the belt is shortened.

SUMMARY OF THE INVENTION

A principal object of the present invention is to provide an image heating apparatus for reducing a degree of heating of a feeding belt by a non-contact heat source from turning-off of the non-contact heat source to a predetermined temperature.

According to one aspect, the present invention provides an image heating apparatus for heating a toner image on a recording material with a liquid developer including toner and a liquid carrier. The image heating apparatus includes a rotatable belt, a driving source, a heating portion, a shielding member, a moving mechanism, and a controller. The rotatable belt is configured to feed the recording material on which the toner image is formed. The driving source is configured to rotate the belt. The heating portion opposes the belt in non-contact with the belt and is configured to heat a developer image on the recording material on the belt by radiant heat. The shielding member is configured to shield heat of the heating portion. The moving mechanism is configured to move the shielding member between a shielding position where the heat of the heating portion is shielded from moving toward the belt between the heating portion and the belt and a retracted position where the shielding member is retracted from the shielding position during an image heating operation. The controller is configured to control the moving mechanism so that the shielding member is in the shielding position, and rotation of the belt is at rest in a stand-by state in which the image heating apparatus waits for input of an image forming signal for forming the image.

Further features of the present invention will become apparent from the following description of exemplary embodiments with reference to the attached drawings.

Figure 2:
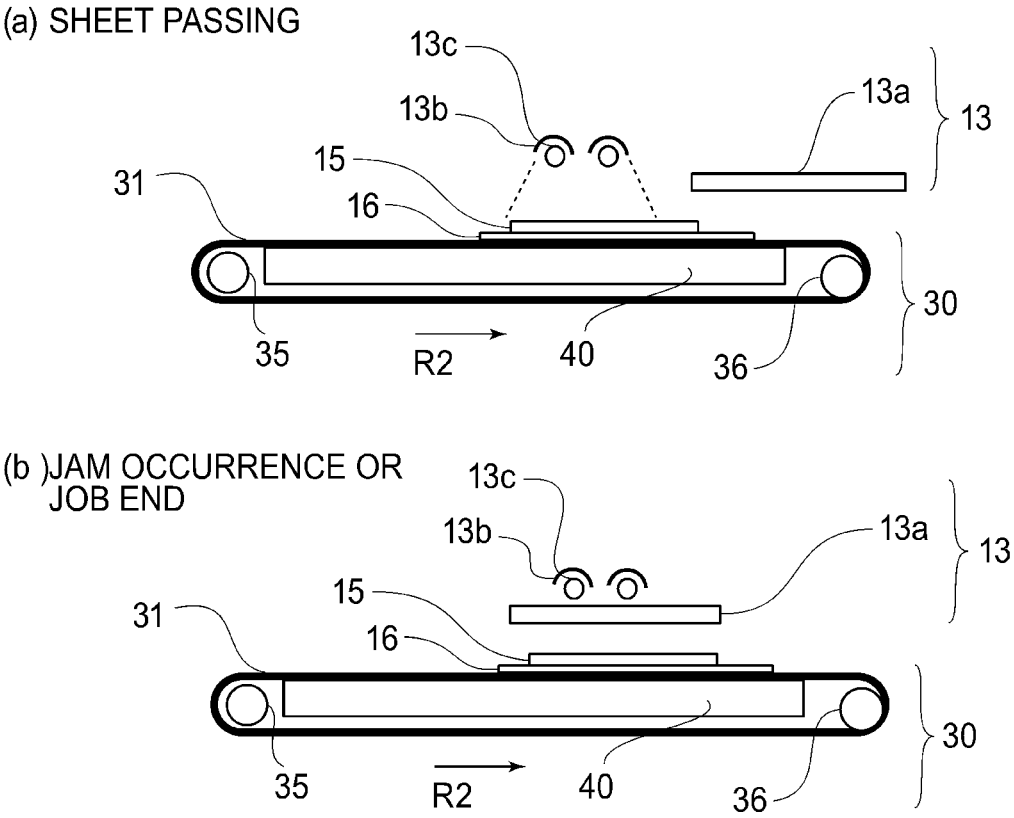

Parts (a) and (b) of FIG. 2 are schematic sectional views illustrating a structure of an image heating apparatus according to the embodiment.

Figure 3:
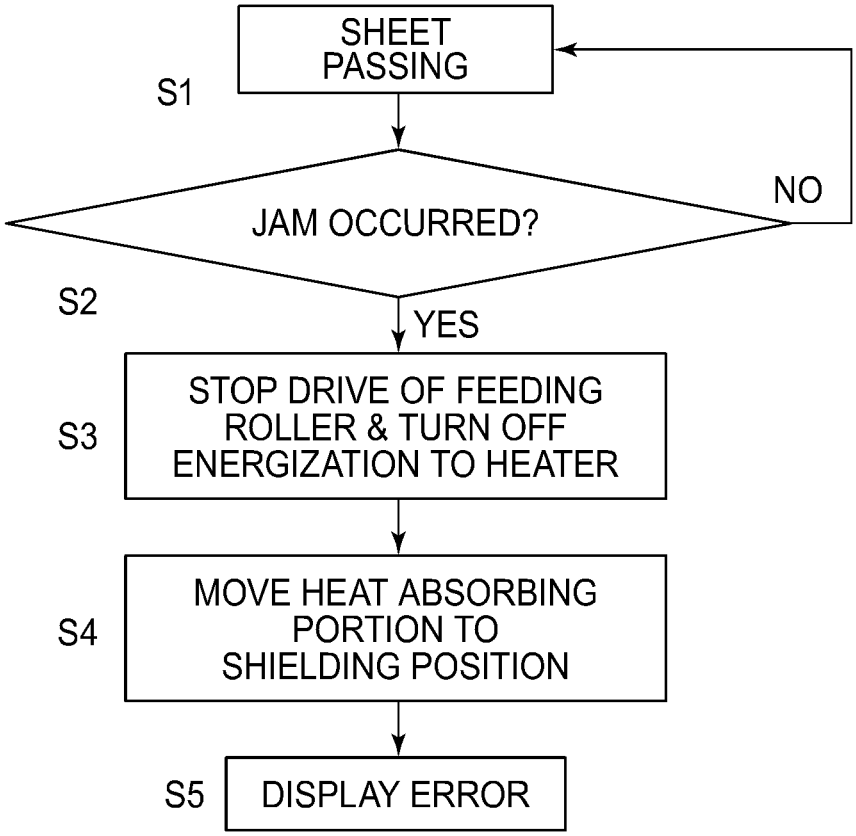

FIG. 3 is an operation flowchart when a shielding mechanism operates during jam occurrence.

Figure 4:
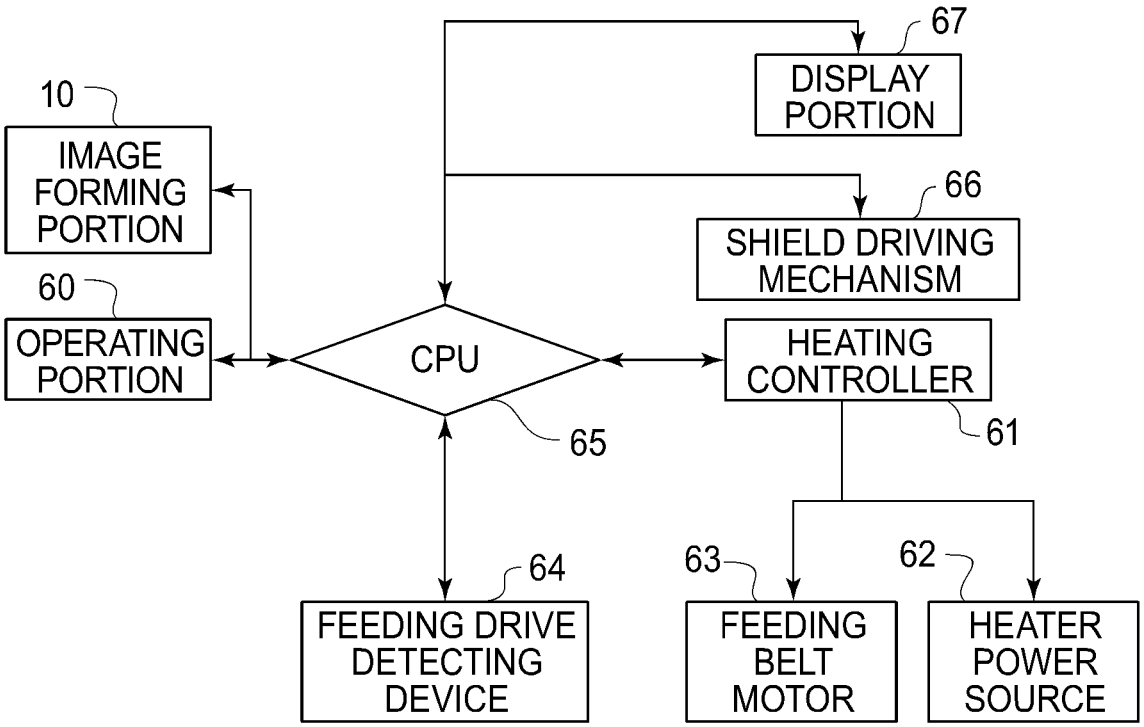

FIG. 4 is a block diagram when the shielding mechanism operates.

Figure 5:
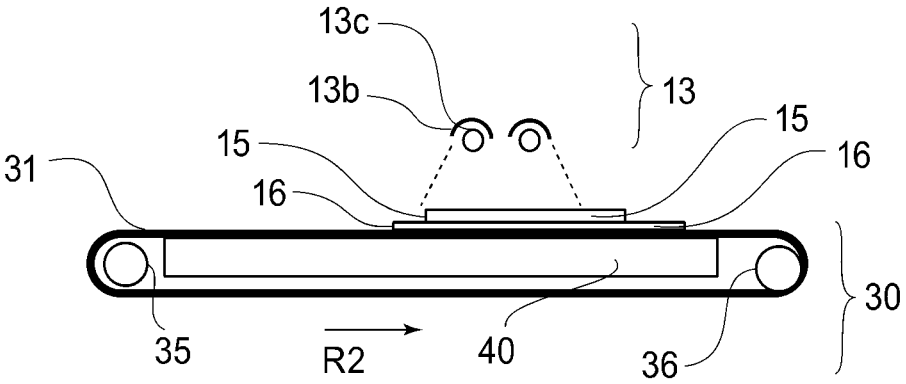

FIG. 5 is a schematic sectional view for illustrating a structure of a conventional image heating apparatus.

Figure 6:
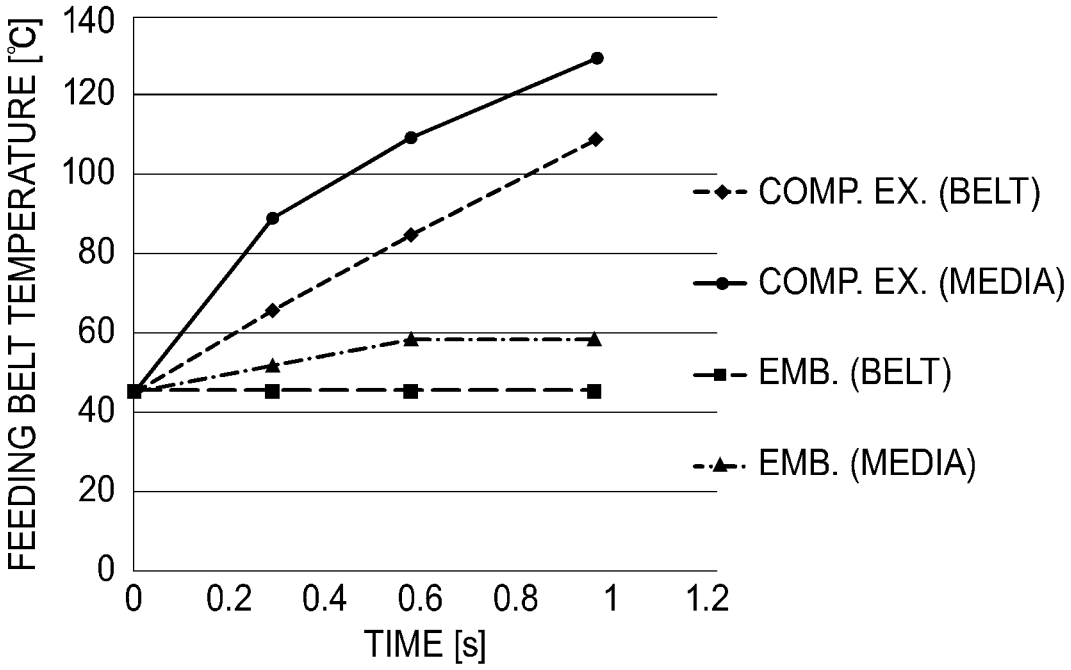

FIG. 6 is a graph showing an experimental result for demonstrating an effect of the embodiment of the present invention.

Figure 7:
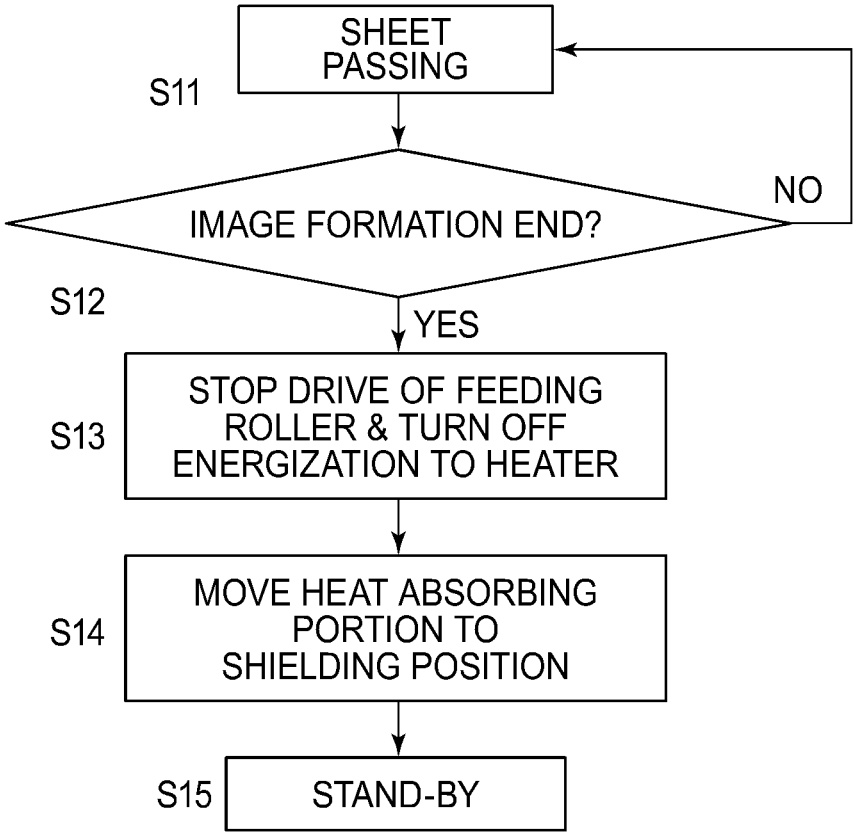

FIG. 7 is an operation flowchart when the shielding mechanism operates after an end of the image formation.

DESCRIPTION OF EMBODIMENTS

In the following, embodiments of the present invention will be specifically described with reference to the drawings by taking an image heating apparatus for fixing an image of a liquid developer as an example.

EMBODIMENT (Image Forming Apparatus)

Figure 1:
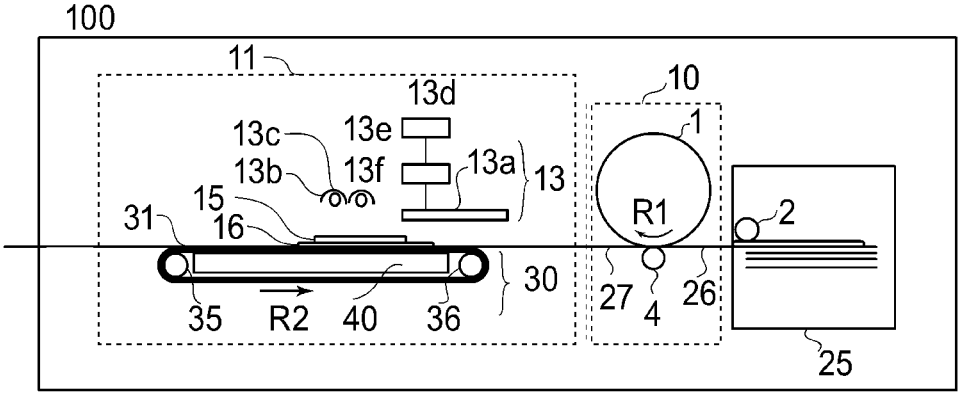
FIG. 1 is a schematic sectional view of a general structure of an image forming apparatus according to an embodiment of the present invention.

FIG. 1 is a schematic view showing an example of an image forming apparatus in which a liquid developer is heated in a non-contact manner.

An image forming apparatus 100 includes an image forming portion 10 for forming an image (toner image) on a recording material 16 and an image heating apparatus (heating device) 11 for heating an image 15 formed on the recording material 16 and for heating the recording material 16. Here, the recording material 16 is a material on which the toner image is formed by the image forming apparatus 100, and for example, includes a sheet such as plain paper, coated paper, a postcard, or an envelope. Further, for example, the recording material 16 may also be an OHP sheet or a film.

A cassette 25 is an accommodating portion for accommodating the recording material 16 used for image formation. The recording material 16 accommodated in the cassette 25 is fed to the image forming portion 10 by a feeding mechanism 2. The feeding mechanism 2 is, for example, a sheet (paper) feeding roller and sends the recording material 16 in the cassette 25 toward a feeding passage 26. Incidentally, the accommodating portion may also have a constitution including a plurality of cassettes and may also have a tray shape (for example, a manual feeding tray).

The recording material 16 fed from the cassette 25 by the feeding mechanism 2 passes through the feeding passage 26 and is supplied to a contact portion between an image bearing member 1 and a transfer means 4. An image on an outer peripheral surface of the image bearing member 1 is transferred by the transfer means 4 onto the recording material 16 at the contact portion between the image bearing member 1 and the transfer means 4, and thereafter, the recording material 16 passes through a feeding passage 27 and is conveyed to the image heating apparatus 11.

The image forming portion 10 forms an image 15 on the recording material 16 with the liquid developer. The liquid developer is a developer containing toner (coloring agent) and a liquid carrier. The image forming portion 10 includes a cylindrical image bearing member 1 and the transfer means 4. An image forming means (not shown) of an electrophotographic type includes a charging portion for electrically charging the image bearing member 1 to a uniform surface potential, an exposure portion for forming a latent image by light exposure, and a developing portion for developing the latent image with the liquid developer, forming an image on the outer peripheral surface of the image bearing member 1. The image 15 formed on the image bearing member 1 is transferred by a transfer roller, as the transfer means 4, onto the recording material 16 supplied to a contact portion between the image bearing member 1 and the transfer means 4. That is, an unfixed toner image 15 is formed on the recording material 16 by the image forming portion 10.

The image bearing member 1 in this embodiment includes an organic photosensitive member surface layer on a surface of an aluminum cylinder (photosensitive drum) of 3 mm in thickness and 84 mm in outer diameter and is 370 mm in width (length in a direction substantially perpendicular to a recording material feeding direction) of a long signal. The image bearing member 1 is rotationally driven about a center supporting shaft as a center in an arrow R1 direction in FIG. 1.

Incidentally, in this embodiment, the image forming apparatus 100 had a constitution of an electrophotographic type and a direct transfer type, but an image forming method to the recording material 16 is not limited thereto. For example, the image forming method may also be a color image forming apparatus including an image forming portion using yellow toner, an image forming portion using cyan toner, an image forming portion using magenta toner, an image forming portion using black toner, and an intermediary transfer belt.

The recording material 16 on which the image 15 is formed in the image forming portion 10 passes through the feeding passage 27 and is conveyed to the image heating apparatus 11. The image heating apparatus 11 includes a heating portion 13 as a non-contact heat source and a sheet feeding (conveying) device 30. The sheet feeding device 30 includes an endless feeding (conveying) belt 31 provided with many holes. The sheet feeding device 30 also includes driving roller 35 and a follower roller 36 that stretch the feeding belt 31. The sheet feeding device 30 includes a driving motor (not shown) for rotating the feeding belt 31 via the driving roller 35. The feeding belt 31 is rotated in a direction of an arrow R2 in the figure by drive of the driving motor. The sheet feeding device 30 carries, on the feeding belt 31, the recording material 16 on which the image 15 is formed by the image forming portion 10, and a conveys the recording material 16 so that the recording material 16 passes below the heating portion 13. The feeding belt 31 in this embodiment is 500 mm in width and 900 mm in peripheral length.

A suction plate 40 and a suction fan (not shown) are provided inside the feeding belt 31 and are used as a suction device for attracting the recording material 16 conveyed by the feeding belt 31 to a peripheral surface of the feeding belt 31 via the many holes formed in the feeding belt 31. The suction plate 40 is provided with a plurality of recessed portions, and the suction fan places an inside of the recessed portions under reduced pressure via holes bored in a bottom of the recessed portions. The suction plate 40 sucks air from an upper surface of the feeding belt 31 passing on the recessed portions thereof an attracts the conveyed recording material 16 to the upper surface of the feeding belt 31.

The heating portion 13 heats the liquid developer by irradiating the image 15 of the liquid developer on the recording material 16 with infrared radiation and fixes the image 15 on the recording material 16.

(Heating Device)

As described above, the heating device 11 includes the heating portion 13 and the sheet feeding device 30. The sheet feeding device 30 is disposed immediately below portions of the heating portion 13 that are adjacently arranged in a feeding direction of the recording material 16 and is constituted so that a single feeding belt passes through an irradiation region of the heating portion 13.

(Structure of Heating Portion)

A structure of the heating portion 13 in the heating device 11 will be specifically described.

The heating device 11 includes the sheet feeding device 30 and the heating portion 13 as shown in FIG. 2. The heating portion 13 is constituted by a quartz (silica) tube (heat generating element) 13*c* emitting infrared radiation with a wavelength of 3 nm as a peak, a reflecting portion 13*b* for reflecting radiation heat emitted by the quartz tube 13*c*, and a heat absorbing portion (shielding member) 13*a*.

The heat absorbing portion 13*a* is constituted by a single member and is 18 J/K or more in thermal capacity, and in this embodiment, as the heat absorbing portion 13*a*, an aluminum plate of 2.5 mm in thickness was used and was disposed in a state in which a surface thereof having emissivity of 0.94 with use of a black-body spray (for example, "OP-96929", manufactured by KEYENCE Corp.) faces the quartz tube 13*c*.

The heat absorbing portion 13*a* is in a retracted position during sheet passing so that the radiant heat emitted by the quartz tube 13*c* is radiated toward a sheet feeding surface as shown in part (a) of FIG. 2, and moves to a shielding position as shown in part (b) of FIG. 2 by a shielding mechanism (moving mechanism) 13*d* at the time of jam occurrence, so that the radiant heat from the quartz tube 13*c* is absorbed by the heat absorbing portion 13*a*. The moving mechanism 13*d* includes a motor 13*e* for moving the heat absorbing portion 13*a* and a drive transmitting portion 13*f* for transmitting a driving force of the motor 13*e* to the heat absorbing portion 13*a*. That is, the shielding position is a position where the heat absorbing portion 13*a* is positioned between the heating portion 13 and the feeding belt 31 and shields movement of the radiant heat toward the feeding belt 31. Further, the retracted position is a position where the heat absorbing portion 13*a* is retracted from the shielding position.

(Structure of Feeding Belt and Suction Plate)

The feeding belt 31 is 500 mm in width, and the suction plate 40 is 490 mm in width, so that the feeding belt 31 sufficiently covers the suction plate 40. Thus, light radiated by the heating portion 13 does not directly heat the suction plate 40.

In this embodiment, the feeding belt 31 is made of EPDM (ethylene-propylene-diene rubber) and is 1 mm in thickness. The suction plate 40 is made of SUS 304 and is 5 mm in thickness.

(Operation of Shielding Mechanism)

An operation during jam occurrence is shown in FIGS. 3 and 4.

First, when an instruction to start printing is provided from an operating portion 60, sheet passing is started in STEP 51 of FIG. 3. A CPU 65, which is a controller, sends a signal of a sheet passing operation to a heating controller 61. The heating controller 61, which received the signal of the sheet passing operation, causes a feeding belt motor 63 to drive and sends, to the CPU 65, a signal indicating that the feeding belt motor 63 is in a driving state. The CPU 65 sends, to a feeding drive detecting device 64, a signal for checking whether or not the feeding belt is in a driving state, and when the feeding belt is in the driving state, the feeding drive detecting device 64 sends a detection result of no abnormality to the CPU 65. Then, the CPU 65 sends a driving state discrimination result of the feeding belt to the heating controller 61, and the heating controller 61 provides an energization instruction to a heater power source 62. The heating controller 61 sends a signal of no abnormality to the CPU 65 at the time when a temperature of the quartz tube 13*c* of the heating portion 11 is placed in a stable state by an unshown means. When the CPU 65 receives the signal of no abnormality from the heating controller 61, the CPU 65 sends a sheet passing OK signal to the image forming portion 10, and the recording material 16 on which the image 15 is formed at the image forming portion 10 is fed to the heating portion 11.

In the case of continuous sheet passing of a plurality of sheets, the CPU 65 receives a sheet passing continuation signal from the image forming portion 10 and sends the sheet passing OK signal to the image forming portion 10 so long as the CPU 65 receives the signal of no abnormality from the heating controller 61.

When a jam occurs in STEP S2, a sequence goes to STEP S3 of FIG. 3. When the jam occurs, an abnormal signal is sent from the feeding drive detecting device 64 to the CPU 65. The CPU 65 sends a signal of abnormality to the heating controller 61, and the heating controller 61 sends an energization cut signal to the heater power source 62, so that feeding and heating are stopped. Then, in STEP S4, the CPU 65 sends a signal to a shielding (member) drive mechanism 66. The shielding drive mechanism 66 moves the heat absorbing portion 13*a* to the state shown in part (b) of FIG. 2, and thereafter sends, to the CPU 65, a signal of an end of heat absorbing portion movement.

Then, the sequence goes to STEP S5. After the operation of STEP S4, the CPU 65 causes a display portion 67 to display an error message of jam occurrence. After an end of jam clearance, when discrimination display of the end of j am clearance is inputted from the operating portion, the error message of the display portion is eliminated, and the image heating apparatus returns to a stand-by state preparing for subsequent sheet passing. Incidentally, in this embodiment, a constitution in which a stop of the energization to the heater and a stop of the rotation of the feeding belt were simultaneously carried out was employed, but a constitution in which the stop of the rotation of the feeding belt is carried out after the stop of the energization to the heater may also be employed.

As a result, local heating by heat of the feeding belt by the heat source during the stop of the feeding belt when the jam occurred can be reduced.

Next an operation of the shielding mechanism after an end of image formation will be described with reference to FIG. 7.

First, when an instruction to start printing is provided from an operating portion 60, sheet passing is started in STEP S11 of FIG. 7. The CPU 65, which is a controller, sends a signal of a sheet passing operation to the heating controller 61. The heating controller 61, which received the signal of the sheet passing operation, causes the feeding belt motor 63 to drive and sends, to the CPU 65, a signal indicating that the feeding belt motor 63 is in a driving state. The CPU 65 sends, to the feeding drive detecting device 64, a signal for checking whether or not the feeding belt is in a driving state, and when the feeding belt is in the driving state, the feeding drive detecting device 64 sends a detection result of no abnormality to the CPU 65. Then, the CPU 65 sends a driving state discrimination result of the feeding belt to the heating controller 61, and the heating controller 61 provides an energization instruction to the heater power source 62. The heating controller 61 sends a signal of no abnormality to the CPU 65 at the time when a temperature of the quartz tube 13*c* of the heating portion 11 is placed in a stable state by an unshown means. When the CPU 65 receives the signal of no abnormality from the heating controller 61, the CPU 65 sends a sheet passing OK signal to the image forming portion 10, and the recording material 16 on which the image 15 is formed at the image forming portion 10 is fed to the heating portion 11.

In the case of continuous sheet passing of a plurality of sheets, the CPU 65 receives a sheet passing continuation signal from the image forming portion 10 and sends the sheet passing OK signal to the image forming portion 10 so long as the CPU 65 receives the signal of no abnormality from the heating controller 61.

When the image formation ends in STEP S12, a sequence goes to STEP S13 of FIG. 7. When the image formation ends, the heating controller 61 sends an energization cut signal to the heater power source 62, so that feeding and heating are stopped. Then, in STEP S14, the CPU 65 sends a signal to a shielding (member) drive mechanism 66. The shielding drive mechanism 66 moves the heat absorbing portion 13*a* to the state shown in part (b) of FIG. 2, and thereafter sends, to the CPU 65, a signal of an end of heat absorbing portion movement.

Then, the sequence goes to STEP S15. After the operation of STEP S14, the state of the CPU 65 goes to a stand-by state in which the CPU 65 waits for input of a new image forming signal. Incidentally, in this embodiment, a constitution in which a stop of the energization to the heater and a stop of the rotation of the feeding belt were simultaneously carried out was employed, but a constitution in which the stop of the rotation of the feeding belt is carried out after the stop of the energization to the heater may also be employed.

The end of the image formation in this embodiment is an end of an operation of a series of an image forming jobs. However, the present invention is not limited to this constitution, but the time of the end of the image formation may also be the time of an end of heating, by the image heating apparatus 11, of the image on the final recording material in the series of image forming jobs.

In this embodiment, when the image forming job is started, in the case when the image forming operation is not interrupted, the heat absorbing portion is continuously kept in the retracted position. In the case of a sheet interval such that the heat absorbing portion is capable of performing a reciprocating operation between the retracted position and the shielding position, a constitution in which the heat absorbing portion is moved between the retracted position and the shielding position at each of sheet intervals may also be employed.

(Confirmation of Effect)

A comparison example is shown in FIG. 5. In the comparison example, a constitution similar to the constitution of this embodiment is employed except that the heat absorbing portion 13*a* of this embodiment is not used.

In order to confirm an effect of this embodiment, in the constitution of the comparison example and the constitution of this embodiment, the following experiments 1 and 2 were conducted.

Experiment 1

The feeding belt 31 was idled for 30 minutes at a process speed of 175 mm/s in a condition that a heating amount of an infrared irradiation device ("IR10545H", manufactured by SAKAGUCHI E.H VOC CORP.) was 1000 W, and thereafter energization to the infrared irradiation device was turned off. Then, a temperature of the feeding belt 31 was measured at a position immediately below the infrared irradiation device.

Experiment 2

A 50 μm-thick polystyrene film was applied onto the feeding belt 31. The feeding belt 31 was idled for 30 minutes at a process speed of 175 mm/s in a condition that a heating amount of an infrared irradiation device ("IR10545H", manufactured by SAKAGUCHI E.H VOC CORP.) was 1000 W, and thereafter energization to the infrared irradiation device was turned off. Then, a media temperature was measured at a position immediately below the infrared irradiation device.

FIG. 6 is a graph showing changes in temperature of the feeding belt 31 and media temperature in one second in the comparison example and in this embodiment when the time immediately after the energization to the infrared irradiation device is turned off is taken as zero seconds. The media temperature is a temperature of the polystyrene film in the experiment 2. A position where the temperature was measured was a peak position where radiant light intensity is strongest if the shielding mechanism was not disposed. In the comparison example in which the shielding mechanism is not used, both the feeding belt temperature and the media temperature increase 100° C. or more, but in this embodiment in which the shielding mechanism is used, the media temperature increases by 19° C. from immediately after the energization to the heater (infrared irradiation device) but remains at about 60° C., so that by the constitution of this embodiment, excessive heating of the feeding belt by the non-contact heat source can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A heating apparatus for heating an image on a recording material with a liquid developer including toner and a liquid carrier, said heating apparatus comprising:

a belt configured to rotate and feed the recording material on which the image is formed;

a driving source configured to rotate said belt;

a heating member opposing said belt such that the heating member is not in contact with said belt, said heating member being configured to heat the image on the recording material on said belt by radiant heat when said heating member is energized;

a shielding member configured to shield heat of said heating portion;

a moving mechanism configured to move said shielding member between a shielding position where (i) said shielding member is positioned between said heating portion and said belt and (ii) said heating member is shielded from facing said belt, and a retracted position where said shielding member is retracted from said shielding position; and a controller configured to control said moving mechanism so that (i) said shielding member moves to the retracted position during an image forming job in which the image on the recording material is fed by the rotation of said belt and is heated and (ii) said shielding member moves from the retracted position to the shielding position after the end of the energization of said heating member and the rotation of said belt is stopped at the end of the image forming job.

2. The heating apparatus according to claim 1, further comprising a suction mechanism provided inside said belt and configured to suck the recording material toward said belt.

3. The heating apparatus according to claim 1, further comprising a reflecting member configured to reflect the radiant heat from said heating member toward the recording material fed by said belt.

4. The heating apparatus according to claim 1, wherein said heating member irradiates the image with infrared radiation prior to irradiating the image with the radiant heat.

5. The heating apparatus according to claim 1, wherein the heating of the image on the recording material fixes the image on the recording material.

6. A heating apparatus for heating an image on a recording material with a liquid developer including toner and a liquid carrier, said heating apparatus comprising:

a belt configured to rotate and feed the recording material on which the image is formed;

a driving source configured to rotate said belt;

a heating member opposing said belt such that the heating member is not in contact with said belt, said heating member being configured to heat the image on the recording material on said belt by radiant heat when said heating member is energized;

a shielding member configured to shield heat of said heating portion;

a moving mechanism configured to move said shielding member between a shielding position where (i) said shielding member is positioned between said heating portion and said belt and (ii) said heating member is shielded from facing said belt, and a retracted position where said shielding member is retracted from said shielding position; and a controller configured to control the moving mechanism so that (i) said shielding member moves to the retracted position during an image forming job in which the image on the recording material is fed by the rotation of said belt and is heated and (ii) said shielding member moves from the retracted position to the shielding position after the end of the energization of said heating member and the rotation of said belt is stopped when a jam occurs during the image forming job.

7. The heating apparatus according to claim 6, further comprising a suction mechanism provided inside said belt and configured to suck the recording material toward said belt.

8. The heating apparatus according to claim 6, further comprising a reflecting member configured to reflect the radiant heat from said heating member toward the recording material fed by said belt.

9. The heating apparatus according to claim 6, wherein said heating member irradiates the image with infrared radiation prior to irradiating the image with the radiant heat.

10. The heating apparatus according to claim 6, wherein the heating of the image on the recording material fixes the image on the recording material.

* * * * *